US006498550B1

(12) United States Patent
Miller et al.

(10) Patent No.: US 6,498,550 B1
(45) Date of Patent: Dec. 24, 2002

(54) FILTERING DEVICE AND METHOD

(75) Inventors: Melvy F. Miller, Tempe, AZ (US); Jeffrey A. Dykstra, Palatine, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/561,559

(22) Filed: Apr. 28, 2000

(51) Int. Cl.[7] ..... H01P 1/207; H01P 1/20
(52) U.S. Cl. ..... 333/208; 333/202; 505/210
(58) Field of Search ..... 333/202, 219.1, 333/208; 505/210

(56) References Cited

U.S. PATENT DOCUMENTS

| | | | | |
|---|---|---|---|---|
| 4,211,987 A | | 7/1980 | Pan | 333/230 |
| 4,691,179 A | * | 9/1987 | Blum et al. | 333/202 |
| 4,725,798 A | * | 2/1988 | Igarashi | 333/212 |
| 4,963,844 A | * | 10/1990 | Konishi et al. | 333/208 |
| 5,821,836 A | * | 10/1998 | Katehi et al. | 333/202 |
| 5,986,331 A | * | 11/1999 | Letavcic et al. | 257/664 |
| 6,011,983 A | * | 1/2000 | Ishikawa | 505/210 |
| 6,191,670 B1 | * | 2/2001 | Nguyen | 333/208 |
| 6,232,854 B1 | * | 5/2001 | Mikami et al. | 333/219.1 |

FOREIGN PATENT DOCUMENTS

EP 0859423 A1 8/1998

OTHER PUBLICATIONS

Papapolymerou, "A Micromachined High–Q X–Band Resonator," IEEE Microwave and Guided Wave Letters, vol. 7, No. 6, Jun. 1997, pp. 168–170.

Konishi, "Novel Dielectric Waveguide Components—Microwave Applications of New Ceramic Materials," Proceedings of the IEEE, Jun. 1991, No. 6, New York, pp. 726–740.

* cited by examiner

*Primary Examiner*—Robert Pascal
*Assistant Examiner*—Stephen E. Jones
(74) *Attorney, Agent, or Firm*—Robert L. King

(57) ABSTRACT

A cavity filter (15) includes a dielectric block (25) disposed adjacent to a conductive layer (23) for producing a resonant frequency of the cavity filter. An electromagnetic signal ($V_A$) propagates within the dielectric block for a predetermined distance to a surface (58) of the conductive layer, where the predetermined distance is one-fourth of a wavelength of the electromagnetic signal at the resonant frequency.

16 Claims, 3 Drawing Sheets

FILTERING DEVICE AND METHOD

The present invention relates in general to integrated circuits, and more particularly to high frequency filtering devices which are integrable with other electrical components.

The demand for wireless communication services is rapidly increasing, so that many frequency bands for cellular telephone and other services are operating at or near their capacities. To accommodate future growth, additional frequency bands are being allocated, but at higher frequencies than existing bands. For example, cellular telephone systems currently operate at frequencies up to 2.4 gigahertz, whereas future systems are expected to operate at 5.8 gigahertz or more.

Many of the components used in portable wireless devices suffer from either a high cost or poor performance at the higher frequencies. For example, cellular telephones use surface acoustical wave (SAW) devices to filter RF carrier signals. However, SAW devices have a high insertion loss, which degrades RF signals and results in poor performance of cellular telephones. Moreover, SAW filters are not commercially available for operation at the higher frequencies.

Other types of filters are not used because of their high parts count and cost and/or their large physical size.

Hence, there is a need for a filtering device which has good performance at high frequencies and which has a low cost and compact size.

DETAILED DESCRIPTION OF THE DRAWINGS

In the figures, elements having the same reference numbers have similar functionality.

Figure 1:
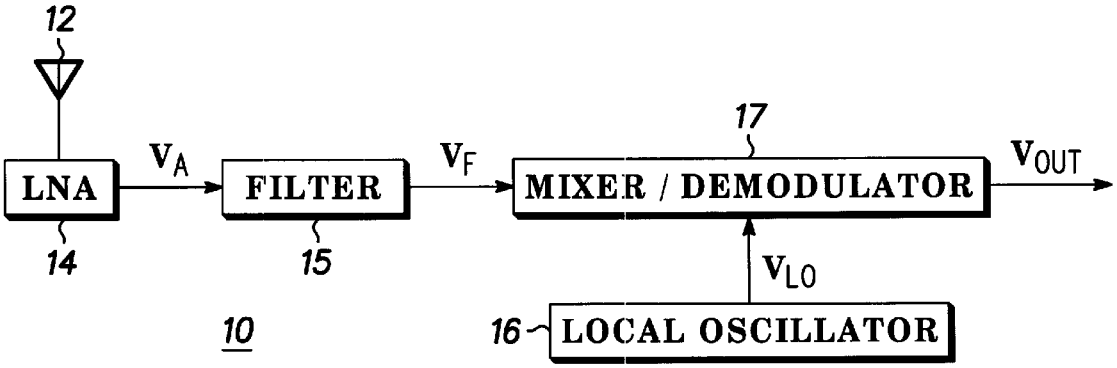
FIG. 1 is a schematic diagram of a portable wireless communications device.

FIG. 1 is a schematic diagram of a wireless communication device 10, including an antenna 12, a low noise amplifier (LNA) 14, a filter 15, a local oscillator (LO) 16, and a mixer/demodulator 17. Wireless communications device 10 may be a cellular telephone, a base station, a pager or other wireless device.

A transmitted radio frequency (RF) signal operating in the 5.8 gigahertz frequency band is received by antenna 12 and coupled to LNA 14 for amplification to produce a signal $V_A$. Filter 15 receives signal $V_A$ and passes frequencies within the 5.8 gigahertz band while rejecting other frequencies to produce a filtered signal $V_F$. Local oscillator 16 produces a local oscillator signal $V_{LO}$. Mixer/demodulator 17 mixes signals $V_F$ and $V_{LO}$ and produces a demodulated baseband output signal $V_{OUT}$ that includes voice and/or data information.

Figure 2:
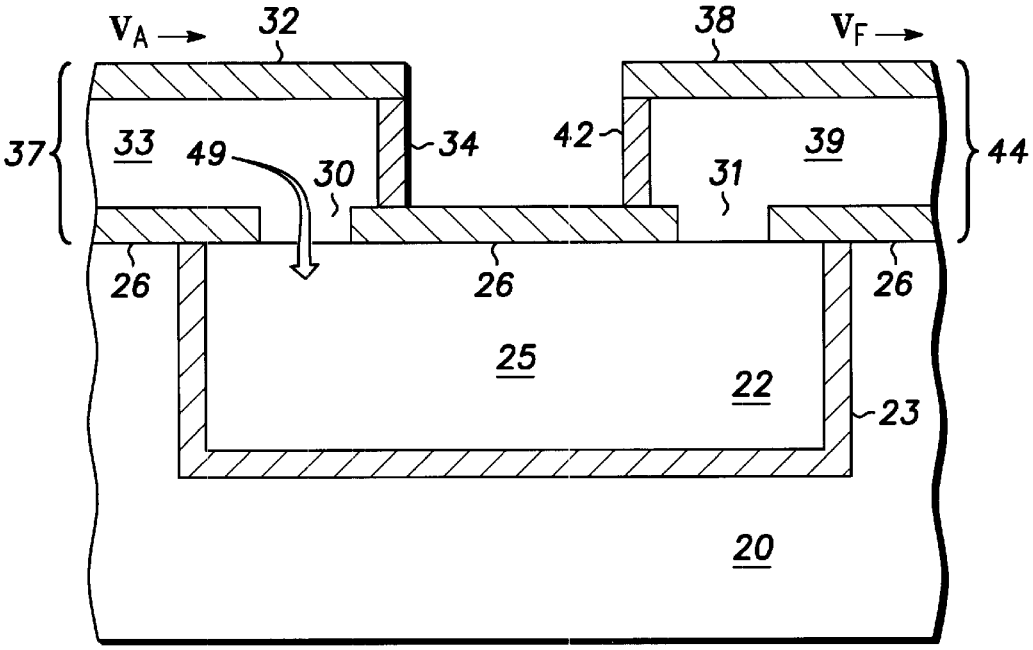
FIG. 2 shows a cross-sectional view of a filter in a first embodiment.

FIG. 2 shows a cross section of filter 15 in a first embodiment. Filter 15 operates as a resonant cavity filter having a resonant frequency of 5.8 gigahertz. Signal $V_A$ propagates on a conductor 32 and is launched into a dielectric block 25 of filter 15 as an electromagnetic wave 49. Frequencies within the 5.8 gigahertz band build up within dielectric block 25 and are coupled to conductor 38 as filtered signal $V_F$.

A substrate 20 is formed with a cavity 22 using an etching, micromachining or similar process. In the first embodiment, cavity 22 is formed to a depth of 250 micrometers. Substrate 20 can comprise a broad variety of materials, such as silicon, gallium arsenide, aluminum oxide, aluminum nitride, or another material.

Interior walls of cavity 22 are coated with a conductive material to form a conductive layer 23, which can be formed by standard processes such as deposition, plating, or another method. To minimize the insertion loss of filter 15, conductive layer 23 preferably has a high conductivity, which can be obtained by the use of a material such as aluminum, copper, gold, silver, or other material, or a combination thereof. Insertion loss is further controlled by forming conductive layer 23 to a thickness exceeding the skin depth of conductive layer 23 at the resonant frequency.

A dielectric material is disposed in cavity 22 to form dielectric block 25 by deposition, by inserting a pre-formed dielectric block 25 into cavity 22, or by another method. Dielectric block 25 comprises a material having a high relative permittivity $\varepsilon_R$ to slow down electromagnetic waves propagating within dielectric block 25, thereby reducing their wavelengths as described in FIG. 3 below. Dielectric block 25 may comprise a broad variety of high permittivity materials, such as strontium titanate, barium strontium titanate or another dielectric material.

A conducting layer 26 is formed over substrate 20 and dielectric block 25 to function as a ground plane for filter 15. Conducting layer 26 preferably comprises a high conductivity material such as aluminum, copper, silver, gold or the like, which can either be the same or a different material than what is used to form conductive layer 23. Conducting layer 26 is coupled to conductive layer 23 to maintain the boundaries of cavity 22 at ground potential. Conducting layer 26 is formed with openings or apertures 30 and 31 to expose portions of dielectric block 25.

A conductor 32, a dielectric 33 and conducting layer 26 combine to operate as a microstrip transmission line 37 to transport signal $V_A$ to a region overlying and adjacent to aperture 30. The dimensions of conductor 32 and the thickness of dielectric 33 are set by the impedance desired for transmission line 37. A via 34 couples conductor 32 to conducting layer 26 to terminate transmission line 37 in a short circuit adjacent to aperture 30, which improves electromagnetic coupling from transmission line 37 through aperture 30 into dielectric block 25. Hence, aperture 30, via 34 and adjacent portions of transmission line 37 function as an input port for filter 15.

Conductor 38, a dielectric 39 and conducting layer 26 combine to operate as a microstrip transmission line 44. The dimensions of conductor 38 and the thickness of dielectric 39 are set by the impedance desired for transmission line 44. A via 42 couples conductor 38 to conducting layer 26 to terminate transmission line 44 in a short circuit to improve coupling from dielectric block 25 through aperture 31 to transmission line 44. Hence, aperture 31, via 42 and adjacent portions of transmission line 44 operate as an output port for filter 15.

Figure 3:
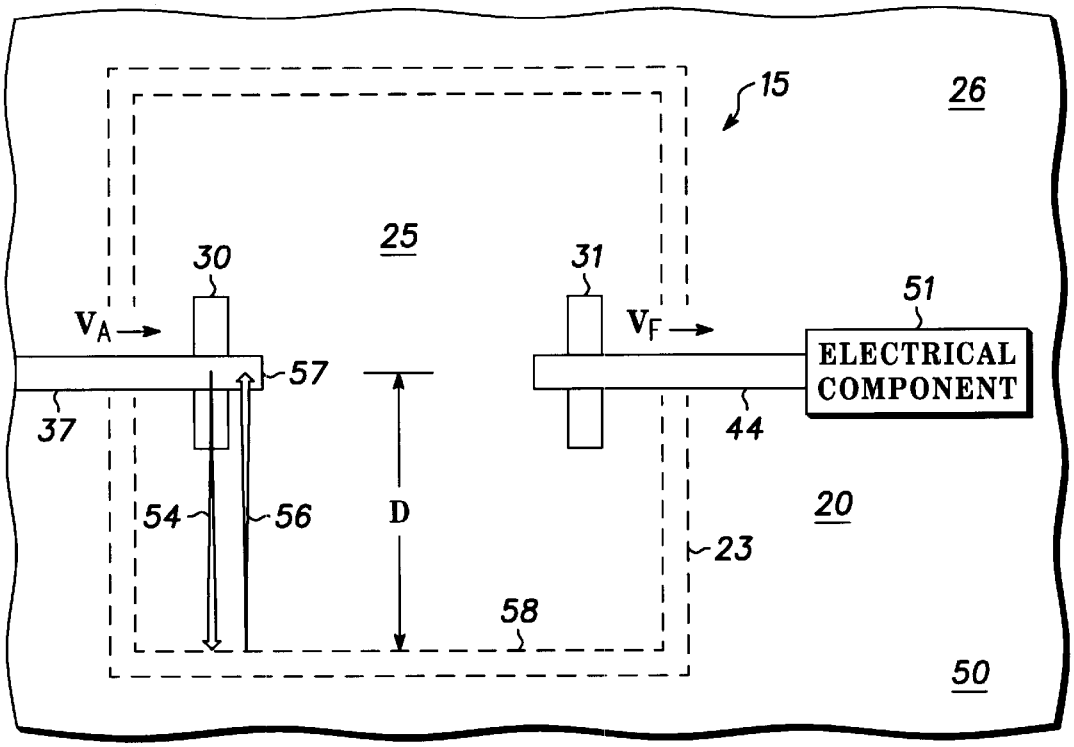
FIG. 3 shows a top view of an integrated circuit.

FIG. 3 is a top view of an integrated circuit 50, including substrate 20, filter 15 (shown in a top view of the first embodiment), and an electrical component 51. Signal $V_A$ propagates along transmission line 37 and through aperture 30, entering dielectric block 25 as an electromagnetic wave at a point underlying aperture 30, designated as entry point 57. Filtered signal $V_F$ leaves dielectric block 25 through aperture 31 and travels along transmission line 44 to electrical component 51.

The operation of filter 15 in a first mode can be understood by referring to rays 54 and 56, which indicate the path taken by a cycle of signal $V_A$ propagating within dielectric block 25. Ray 54 travels a distance D from entry point 57 to a surface 58 of conductive layer 23. Ray 54 is phase inverted at surface 58 and reflected as ray 56, which returns to entry point 57 after rays 54 and 56 travel a combined distance 2*D.

A feature of the present invention is the use of a high permittivity material to form dielectric block 25, which allows the physical dimensions of dielectric block 25 to be reduced while still maintaining a desired frequency selectivity. The relative permittivity $z,1_R$ of dielectric block 25 is selected to be greater than one in order to slow down rays 54 and 56 to a velocity $V=V_0/z,1_R^{1/2}$, where $V_0$ is their velocity in free space. Hence, ray 56 returns to entry point 57 after a time $T=(2*D*z,1_R^{1/2})/V_0$. At a frequency $F=V_0/(2*D*\mathcal{Y}_R^{1/2})$, ray 56 will reach entry point 57 aligned in phase with a subsequent cycle of signal $V_A$. Such constructive interference occurs when propagation distance D is equal to one-fourth of a wavelength of frequency F, resulting in energy building up within dielectric block 25 at frequency F. Filter 15 is said to resonate at frequency F. That is, frequency F is a resonant frequency of filter 15. Hence, increasing the relative permittivity $\mathcal{Y}_R$ of dielectric block 25 allows the propagation distance D, and the dimensions of filter 15, to be reduced while maintaining a constant resonant frequency.

At nonresonant frequencies, ray 56 returns to entry point 57 out of phase with a subsequent cycle of signal $V_A$. Such destructive interference effectively cancels or suppresses ray 56 so that little or no energy is stored in dielectric block 25 at the nonresonant frequencies. The combination of constructive and destructive interference produces a frequency selective characteristic for filter 15.

Table 1 shows examples of surface dimensions of filter 15 operating with a 5.8 gigahertz resonant frequency. Dimensions are given in millimeters as a function of the relative permittivity $\mathcal{Y}_R$ of dielectric block 25.

TABLE 1

| Relative Permittivity ($\mathcal{Y}_R$) | Dimensions of Cavity 22 (mm) |
|---|---|
| 1 | 36.7 × 36.7 |
| 60 | 4.6 × 4.6 |
| 200 | 2.4 × 2.4 |
| 500 | 1.56 × 1.56 |

It is often desirable for filter 15 to have a compact size in order to produce a low manufacturing cost for integrated circuit 50. For example, where substrate 20 comprises a semiconductor material and dielectric block 25 has a relative permittivity $\mathcal{Y}_R$ greater than about 60, cavity 22 will have surface dimensions less than about 4.6 millimeters on a side.

Note that filter 15 may operate in modes other than the first operating mode described above. For example, electromagnetic waves could reflect off of a surface different from surface 58, and resonance may occur either at the same or at a different frequency depending on the distance traveled by the electromagnetic waves.

Electrical component 51 comprises a passive or active electrical component disposed on substrate 20. Electrical component 51 is optionally coupled to filter 15 by transmission line 44. Electrical component 51 can comprise a passive component such as a resistor, capacitor, inductor, or other passive component. Where substrate 20 comprises a semiconductor material, component 51 may be configured as one or more transistors formed on substrate 20 using standard integrated circuit processing methods. Electrical component 51 may include an array of components which are interconnected with each other or with other system components.

Figure 4:
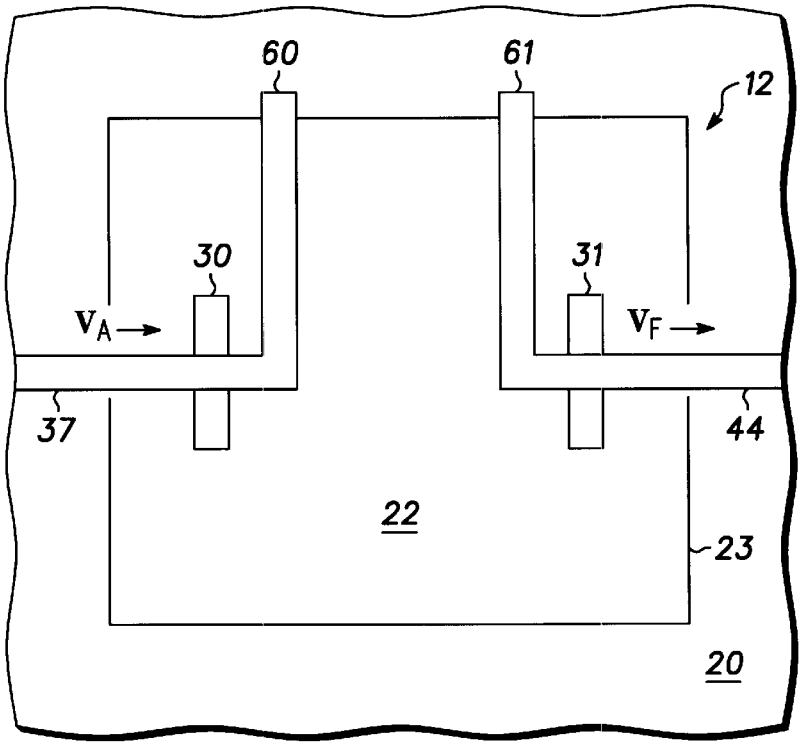
FIG. 4 shows a top view of a filter in a second embodiment.

FIG. 4 shows a top view of filter 15 in a second embodiment, including cavity 22 formed in substrate 20, transmission lines 37 and 44, and apertures 30 and 31. In the second embodiment, transmission line 37 is extended from aperture 30 to endpoint 60 a distance equal to one-fourth of a wavelength of a desired resonant frequency of filter 15. Similarly, transmission line 44 is extended from aperture 31 to endpoint 61 a distance equal to one-fourth of a wavelength of the desired resonant frequency.

Transmission lines 37 and 44 are terminated in open circuits, which reduces processing cost by eliminating the need for vias 34 and 42 (shown in FIG. 2). Open circuit endpoint terminations improve the coupling of electromagnetic signals in the regions of apertures 30 and 31.

Figure 5:
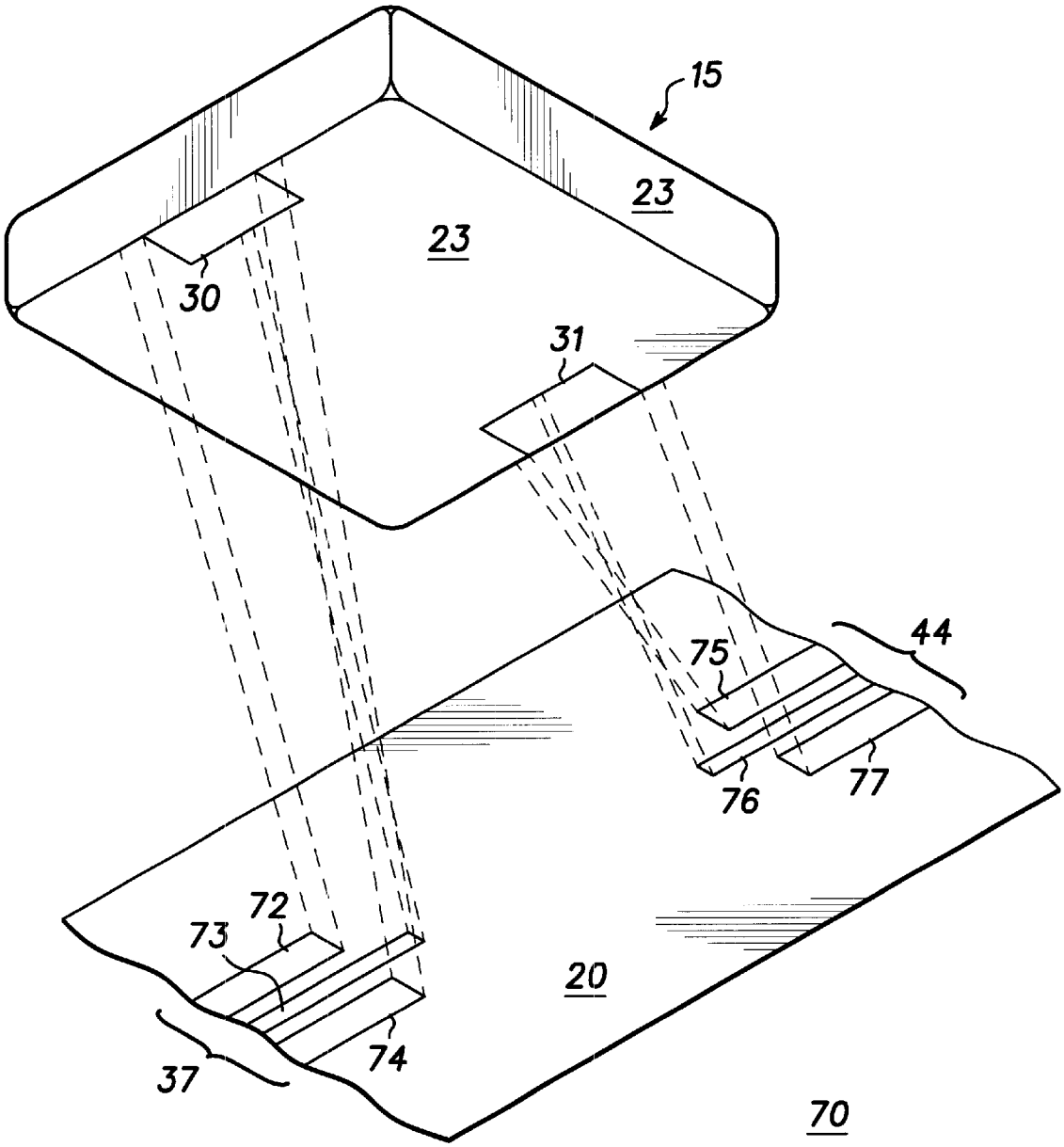
FIG. 5 shows an exploded view of a filter in a third embodiment.

FIG. 5 shows an exploded view of a filtering device 70, including substrate 20 and filter 15 in a third embodiment. Transmission lines 37 and 44 are formed as coplanar transmission lines on substrate 20. Transmission line 37 includes conductors 72 and 74 functioning as ground planes and a conductor 73 for transporting signal $V_A$ to filter 15. Transmission line 44 includes conductors 75 and 77 functioning as ground planes and a conductor 76 for transporting filtered signal $V_F$ from filter 15.

Filter 15 includes dielectric block 25 which is coated with conductive layer 23 for reflecting electromagnetic waves within dielectric block 25. Aperture 30 is formed in conductive layer 23 to couple signal $V_A$ between transmission line 37 and dielectric block 25. Aperture 31 is formed in conductive layer 23 to couple filtered signal $V_F$ between dielectric block 25 and transmission line 44.

Filter 15 is aligned and surface mounted to substrate 20 so that conductors 72, 74, 75 and 77 are coupled to conductive layer 23, thereby ensuring that conductive layer 23 operates at ground potential. Conductors 73 and 76 are coupled to conductive layer 23 to terminate transmission lines 37 and 44 with short circuits.

The third embodiment of filter 15 shown in FIG. 5 has an advantage of reduced processing cost by eliminating the need to form a cavity in substrate 20. Moreover, the application of conductive layer 23 directly to dielectric block 25 rather than to a cavity wall reduces the potential for voids between conductive layer 23 and dielectric block 25, which can degrade the performance of filter 15.

As seen in the foregoing description, the present invention provides an improved filtering device and method of filtering high frequency signals. An electromagnetic wave propagates within a dielectric block for a predetermined distance from an entry point to an adjacent conductive layer. The electromagnetic wave is reflected from a surface of the conductive layer back to the entry point. When the predetermined distance is equal to one fourth of a wavelength of the electromagnetic wave, the reflected wave constructively interferes with a subsequent cycle of the electromagnetic wave to produce a resonant frequency of the filtering device. At nonresonant frequencies, the reflected wave destructively interferes with the subsequent cycle to produce a frequency selectivity in the filtering device.

It is understood that the benefits of the present invention may be obtained with embodiments different from those disclosed herein. For example, the filtering device may be configured as a single port device to operate as a frequency dependent load or impedance device.

What is claimed is:

1. A filter, comprising:

a first conductive layer positioned in a substrate of semiconductor material to form a cavity and having a first surface for reflecting an electromagnetic wave;

a dielectric block of a dielectric material having a relative permittivity substantially greater than one and disposed adjacent to the first conductive layer and completely filling the cavity, for propagating the electromagnetic wave a first distance to the first surface of the first conductive layer to determine a resonant frequency of the filter, the first distance being determined by size of the dielectric block and established to be equal to one-fourth of a wavelength of the resonant frequency of the filter;

a second conductive layer overlying the substrate and the dielectric block and formed with a first opening and a second opening overlying the dielectric block to thereby have first, second and third portions of the second conductive layer, the first opening being defined by the first and second portions and coupling the electromagnetic wave as an input, the second opening being defined by the second and third portions and coupling the electromagnetic wave as an output;

a first dielectric overlying the first portion of the second conductive layer and filling the first opening;

a second dielectric overlying the third portion of the second conductive layer and filling the second opening;

a first conductor overlying the first dielectric, wherein the first portion of the second conductive layer, the first dielectric and the first conductor jointly form a first transmission line for collectively inputting the electromagnetic wave;

a first conductive via connected between the first conductor and the second portion of the second conductive layer to terminate the first transmission line in a first short circuit adjacent the first opening;

a second conductor overlying the second dielectric, wherein the third portion of the second conductive layer, the second dielectric and the second conductor jointly form a second transmission line for collectively outputting the electromagnetic wave; and a second conductive via connected between the second conductor and the second portion of the second conductive layer to terminate the second transmission line in a second short circuit adjacent the second opening to improve coupling from the dielectric block through the second opening to the second transmission line.

2. The filter of claim 1, wherein the resonant frequency is additionally determined by the relative permittivity of the dielectric block.

3. The filter of claim 1, where the dielectric block comprises a material having a relative permittivity of substantially sixty or more.

4. The filter of claim 1, where the resonant frequency of the filter is approximately 5.8 gigahertz.

5. An integrated circuit, comprising:

a substrate having a surface defining a cavity; and a filter, comprising:

a first conductive layer formed on a surface of the cavity for reflecting an electromagnetic wave;

a first dielectric material disposed in the cavity to fill the cavity, for propagating the electromagnetic wave a first distance to a first surface of the first conductive layer to set a resonant frequency of the filter, the first distance being equal to one-fourth of a wavelength of the resonant frequency of the filter;

an input transmission line having a second dielectric material adjoined by a first conductive layer and a second conductive layer overlying the dielectric material, the first conductive layer defining an input aperture for inputting the electromagnetic wave to the first dielectric material and an output aperture for outputting the electromagnetic wave in filtered form;

a first via for electrically connecting the first and second conductive layers to terminate the input transmission line in a short circuit adjacent the input aperture;

an output transmission line adjoining the output aperture and having a third dielectric material adjoined by the first conductive layer and a third conductive layer; and a second via for electrically connecting the third conductive layer to the first conductive layer to terminate the output transmission line in a short circuit adjacent to the output aperture to improve coupling from the first dielectric material through the second aperture to the output transmission line.

6. The integrated circuit of claim 5, wherein the first dielectric material has a relative permittivity of at least sixty.

7. The integrated circuit of claim 5 wherein the first via and the second via are connected to a continuous portion of the second conductive layer that is adjacent to both the first aperture and the second aperture.

8. The integrated circuit of claim 7 wherein the input transmission line and the output transmission line are formed as coplanar transmission lines on the substrate.

9. The integrated circuit of claim 7, wherein the second dielectric material has a thickness and the second conductive layer is formed with dimensions determined by a desired impedance of the input transmission line.

10. The integrated circuit of claim 5, wherein the resonant frequency is 5.8 gigahertz and the cavity is formed with dimensions less than five millimeters.

11. The integrated circuit of claim 5, further comprising an electrical component formed on the surface of the substrate.

12. The integrated circuit of claim 11, wherein the substrate comprises a semiconductor material and the electrical component includes a transistor.

13. A method of filtering a signal, comprising:

positioning a conductive layer in a substrate of semiconductor material to form a cavity and using a first surface of the conductive layer to reflect the signal;

providing a dielectric mass in the cavity having a relative permittivity greater than ten, and propagating the signal a distance through the dielectric mass substantially equal to one-fourth of a wavelength of a predetermined resonant frequency to produce a filtered signal at a frequency determined by the distance;

forming an input aperture to the dielectric mass;

coupling an input transmission line to the input aperture, the input transmission line comprising three distinct layers and being terminated in a first short circuit adjacent to the input aperture to improve electromagnetic coupling from the input transmission line into the dielectric mass;

forming an output aperture to the dielectric mass; and coupling an output transmission line to the output aperture, the output transmission line also comprising three distinct layers and being terminated in a second short circuit adjacent to the output aperture for improving coupling from the dielectric mass to the output transmission line.

14. The method of claim 13, further comprising the step of providing the dielectric mass in the cavity with a relative permittivity of at least sixty.

15. The method of claim 13, wherein the step of providing the dielectric mass in the cavity further comprises using one of strontium titanate or barium strontium titanate as the dielectric mass.

16. The method of claim 15, further comprising the step of implementing the conductive surface with a material selected from the group consisting of aluminum, copper, gold, silver or a combination thereof.

* * * * *